US010557682B2

(12) United States Patent
Kilgore

(10) Patent No.: US 10,557,682 B2
(45) Date of Patent: Feb. 11, 2020

(54) GOBO PROJECTION TARGETING DEVICE

(71) Applicant: RTK Holdings, LLC, Chesapeake, VA (US)

(72) Inventor: Jeremy T. Kilgore, Chesapeake, VA (US)

(73) Assignee: RTK HOLDINGS, LLC, Chesapeake, VA (US)

( * ) Notice: Subject to any disclaimer, the term of this patent is extended or adjusted under 35 U.S.C. 154(b) by 0 days.

(21) Appl. No.: 16/015,037

(22) Filed: Jun. 21, 2018

(65) Prior Publication Data

US 2018/0372449 A1 Dec. 27, 2018

Related U.S. Application Data

(60) Provisional application No. 62/525,275, filed on Jun. 27, 2017, provisional application No. 62/659,108, filed on Apr. 17, 2018, provisional application No. 62/566,895, filed on Oct. 2, 2017, provisional application No. 62/615,125, filed on Jan. 9, 2018.

(51) Int. Cl.

| | |
|---|---|
| ***F41G 1/35*** | (2006.01) |
| ***F21V 14/06*** | (2006.01) |
| ***F21V 11/06*** | (2006.01) |
| *F41G 3/08* | (2006.01) |

(52) U.S. Cl.

CPC ..... *F41G 1/35* (2013.01); *F21V 11/06* (2013.01); *F21V 14/065* (2013.01); *F41G 3/08* (2013.01)

(58) Field of Classification Search

CPC ... F41G 1/35; F41G 3/08; F41V 11/06; F21V 14/065; F21V 33/008

See application file for complete search history.

(56) References Cited

U.S. PATENT DOCUMENTS

| | | | | |
|---|---|---|---|---|
| 4,616,421 | A * | 10/1986 | Forsen | F41G 1/12 42/122 |
| 4,627,183 | A * | 12/1986 | Stuckman | F41G 1/35 362/110 |
| 4,779,176 | A | 10/1988 | Bomhorst | |
| 6,565,227 | B1 | 5/2003 | Davis | |
| 6,685,347 | B2 | 2/2004 | Grutze | |
| 6,714,564 | B1 * | 3/2004 | Meyers | F41G 1/35 359/727 |
| 6,746,124 | B2 * | 6/2004 | Fischer | F21L 4/027 353/102 |

(Continued)

*Primary Examiner* — Benjamin P Lee

(74) *Attorney, Agent, or Firm* — Bennet K. Langlotz; Langlotz Patent & Trademark Works, LLC

(57) ABSTRACT

Gobo projection targeting devices have a light source, a lens assembly associated with the light source, the lens assembly having a first element, a second element, and an aiming figure, the first element being closer to the light source, and the second element having a smaller diameter than the first element, such that a first portion of light emitted by the light source and transmitted by the first element will bypass the second element and a second portion of light emitted by the light source and transmitted by the first element will not bypass the second element. The first and second elements may each be converging lenses. The second element may be adapted to generate an image of the aiming figure away from the illuminator. The first portion of light may be a field illumination pattern lacking a focused image. The lens assembly may be movable.

12 Claims, 7 Drawing Sheets

(56) References Cited

U.S. PATENT DOCUMENTS

| | | | | |
|---|---|---|---|---|
| 8,016,451 | B2 | 9/2011 | Householder et al. | |
| 8,793,920 | B2 * | 8/2014 | Singh | F41G 1/473 42/115 |
| 9,541,817 | B2 | 1/2017 | Moran | |
| 2001/0043313 | A1 * | 11/2001 | Okura | G03B 21/14 353/97 |
| 2005/0180808 | A1 * | 8/2005 | Cui | F21V 33/0048 401/195 |
| 2009/0217565 | A1 * | 9/2009 | Ford | F41A 17/08 42/114 |
| 2011/0080736 | A1 * | 4/2011 | Brands | F21V 5/006 362/277 |
| 2012/0176802 | A1 | 7/2012 | Householder et al. | |
| 2012/0180367 | A1 * | 7/2012 | Singh | F41G 1/35 42/117 |
| 2013/0000172 | A1 * | 1/2013 | Ford | F41A 17/08 42/70.01 |
| 2013/0283661 | A1 * | 10/2013 | Lynn | F41G 1/35 42/114 |
| 2014/0204347 | A1 | 7/2014 | Murphy | |
| 2015/0146415 | A1 * | 5/2015 | Li | F21V 14/065 362/157 |
| 2015/0198417 | A1 | 7/2015 | Werner | |
| 2016/0047624 | A1 * | 2/2016 | Hancosky | F41G 1/54 42/113 |
| 2017/0159921 | A1 | 6/2017 | Morris | |
| 2017/0176140 | A1 * | 6/2017 | Harrison | F41G 1/35 |

* cited by examiner

GOBO PROJECTION TARGETING DEVICE

CROSS-REFERENCE TO RELATED APPLICATION

This application claims the benefit of U.S. Provisional Patent Application No. 62/525,275 filed on Jun. 27, 2017, entitled "Focusable Lighting Device with Gobo Projections for Use with a Firearm," and also claims the benefit of U.S. Provisional Patent Application No. 62/615,125 filed on Jan. 9, 2018, entitled "Gobo Projection Targeting Device," and also claims the benefit of U.S. Provisional Patent Application No. 62/659,108 filed on Apr. 17, 2018, entitled "Gobo Projection Targeting Device," and also claims the benefit of U.S. Provisional Patent Application No. 62/566,895 filed on Oct. 2, 2017, entitled "Gobo Projection Targeting Device," which are hereby incorporated by reference in their entirety for all that is taught and disclosed therein.

FIELD OF THE INVENTION

The present invention relates to firearms, and more particularly to a gobo projection targeting device that projects a focused image on a target.

BACKGROUND OF THE INVENTION

A gobo is a metal, plastic, glass, ink, etching, or other obstruction pattern that positioned inside or in front of a light source to control the shape of the emitted light by producing patterns of light and shadow. In theatrical lighting, the term refers to a device placed at the point of focus between the source of illumination and an optical lens. This placement is critical to enable the production of a crisp, sharp edged pattern or design. The gobo blocks certain light rays, certain wavelengths of light, or certain colors of light, in a determined pattern or manner, while the optical lens focuses light rays. Conventional gobo projectors do not have a dual purpose of bringing the gobo image in and out of focus so the user can use the gobo projector as a flashlight when the gobo image is out of focus.

The use of a flashlight or other illumination device attached to a firearm to provide illumination in low light or dark environments is well known. It is also well known to attach a laser to a firearm to project a dot onto a target, thereby indicating a relative point of impact of a round fired from the firearm. However, each of these solutions have various shortcomings. A flashlight is capable of illuminating a target, but does not indicate a relative point of impact of a round fired from the firearm. A laser does not enable a user to clearly see a large portion or the entirety of a target, as well as at least a portion of the area around the target.

Therefore, a need exists for a new and improved gobo projection targeting device that projects a focused image on a target. In this regard, the various embodiments of the present invention substantially fulfill at least some of these needs. In this respect, the gobo projection targeting device according to the present invention substantially departs from the conventional concepts and designs of the prior art, and in doing so provides an apparatus primarily developed for the purpose of projecting a focused image on a target.

SUMMARY OF THE INVENTION

The present invention provides an improved gobo projection targeting device, and overcomes the above-mentioned disadvantages and drawbacks of the prior art. As such, the general purpose of the present invention, which will be described subsequently in greater detail, is to provide an improved gobo projection targeting device that has all the advantages of the prior art mentioned above.

To attain this, the preferred embodiment of the present invention essentially comprises a light source, a lens assembly associated with the light source, the lens assembly having a first element, a second element, and an aiming figure, the first element being closer to the light source, and the second element having a smaller diameter than the beam angle of the first element, such that a first portion of light emitted by the light source and transmitted by the first element will bypass the second element and a second portion of light emitted by the light source and transmitted by the first element will not bypass the second element. The first and second elements may each be converging lenses. The second element may be adapted to generate an image of the aiming figure away from the illuminator. The first portion of light may be a field illumination pattern lacking a focused image. The lens assembly may be movable with respect to the light source through a range of positions between a more proximate position and a less proximate position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
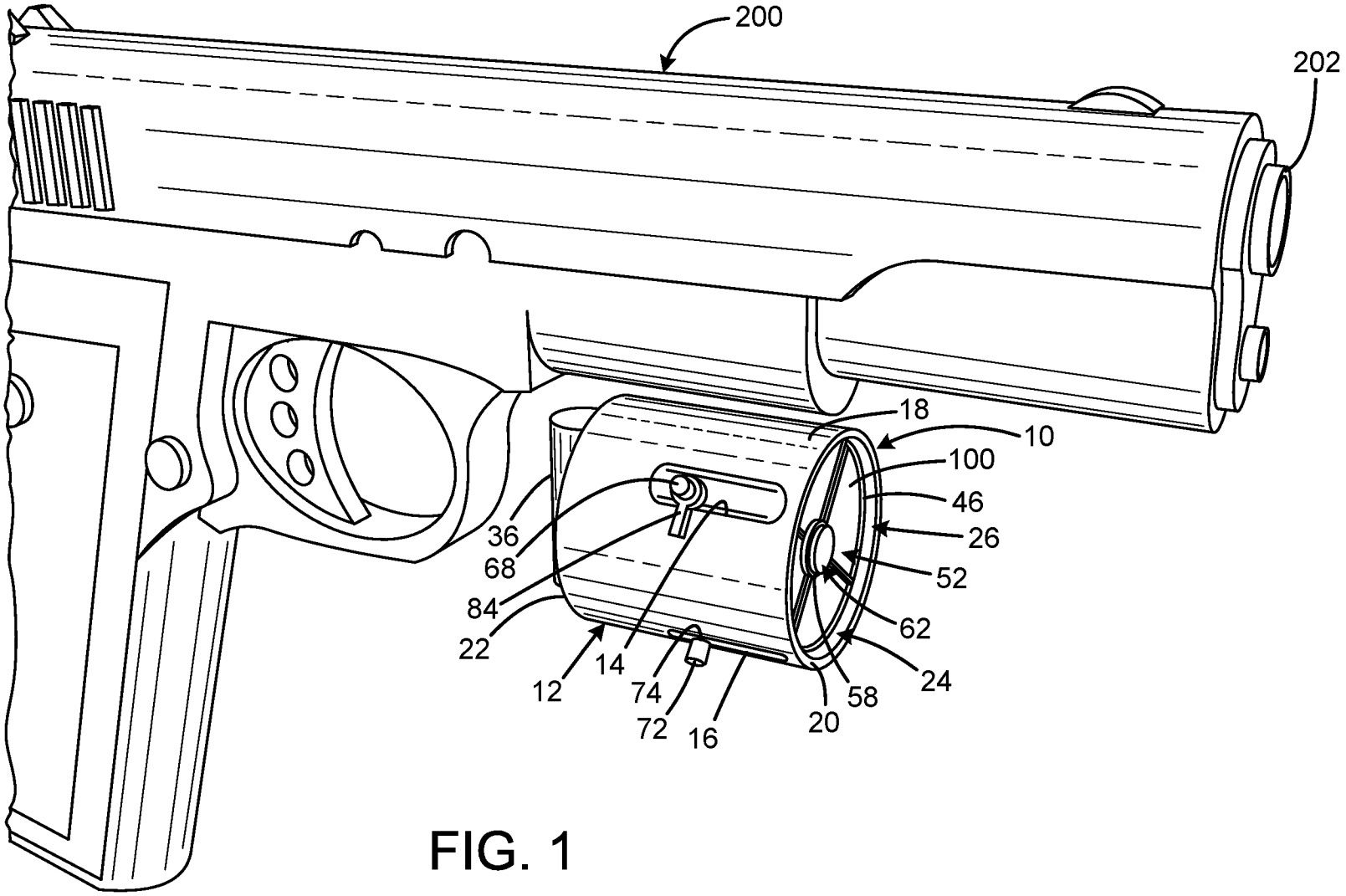
FIG. 1 is a front isometric view of the current embodiment of the gobo projection targeting device constructed in accordance with the principles of the present invention installed on a pistol.

A current embodiment of the gobo projection targeting device of the present invention is shown and generally designated by the reference numeral 10.

Figure 2:
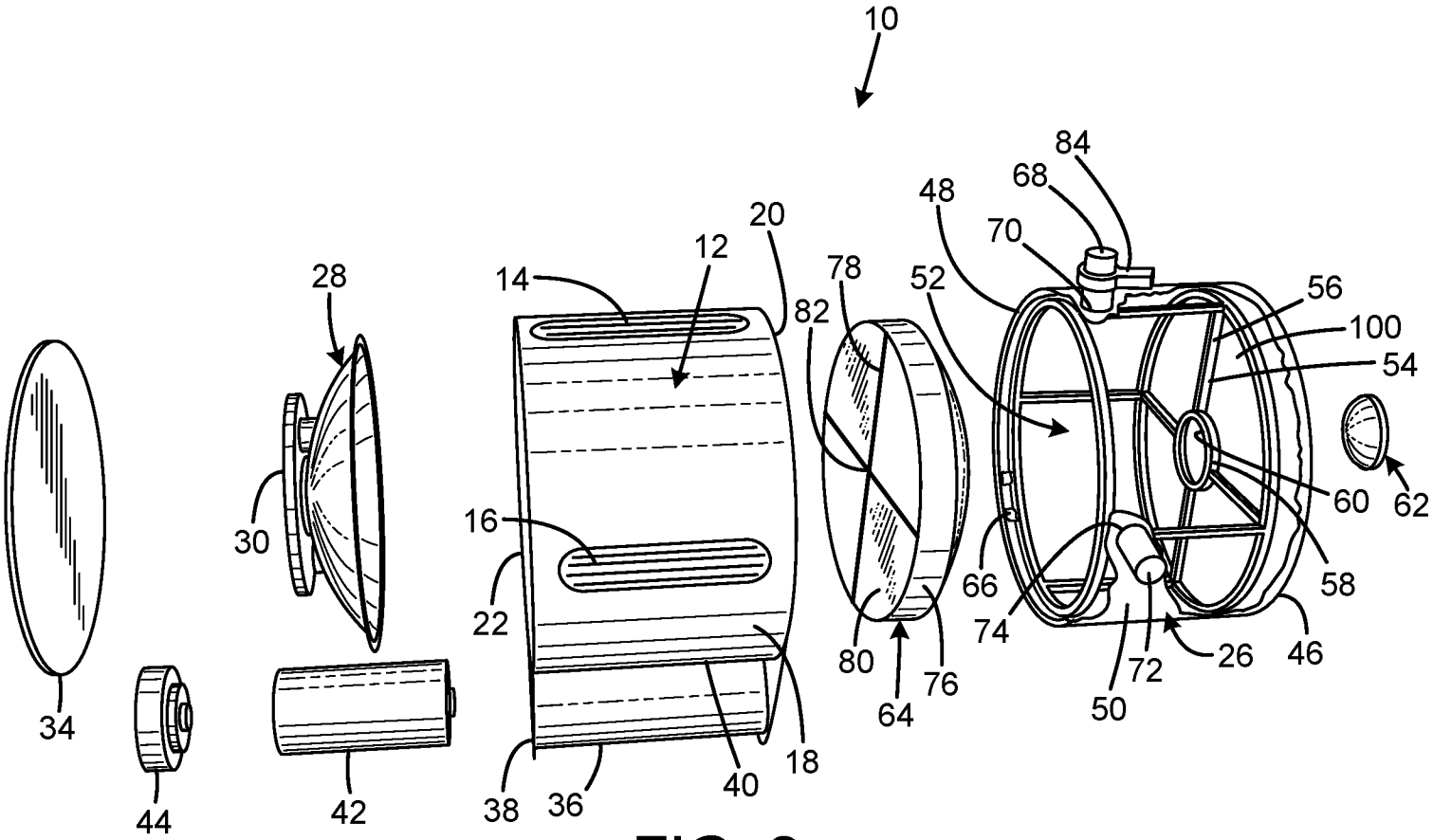
FIG. 2 is an exploded view of the gobo projection targeting device of FIG. 1 removed from the pistol.
Figure 3:
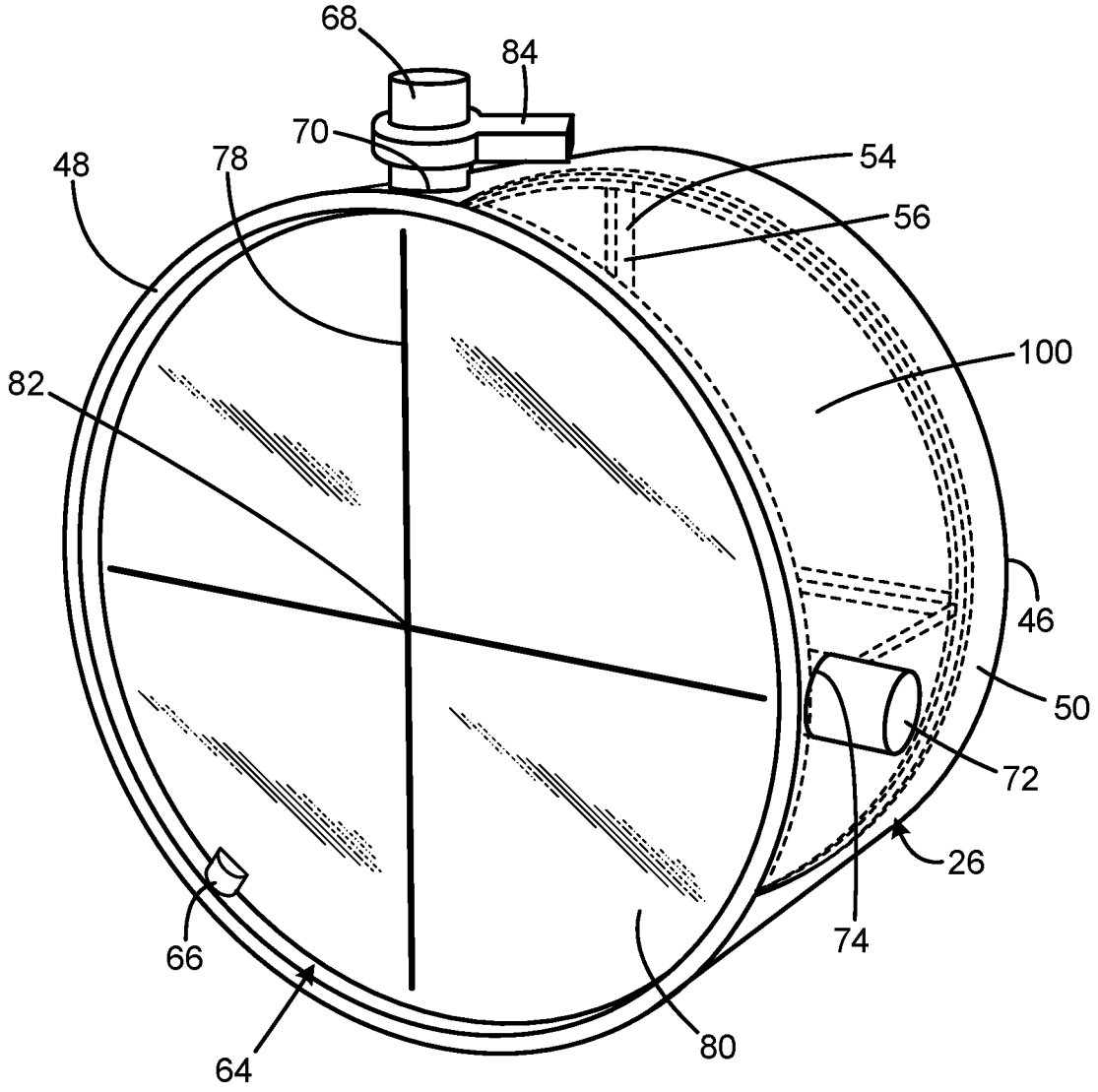
FIG. 3 is a rear isometric view of the inner body of FIG. 1 removed from the body.

FIGS. 1-3 illustrate the improved gobo projection targeting device 10 of the present invention. More particularly, the targeting device is shown installed on a pistol 200 in FIG. 1.

The targeting device has a cylindrical body 12 with a top longitudinal sliding cutout 14 and a right side longitudinal sliding cutout 16 located on the perimeter 18. The body has an open front 20 and an open rear 22 that provide access to a hollow interior 24. The interior receives an inner body 26 and a reflector 28 with an attached circuit board 30 with light source 32 (shown in FIGS. 4 & 5). The reflector is secured in a stationary position within the body and directs light rays 86 (shown in FIGS. 4 & 5) emitted by the light source forward. In the current embodiment, the light source is a Light Emitting Diode (LED). A body cap 34 attached to the rear of the body releasably secures the inner body and reflector within the body. A battery compartment 36 having an open rear 38 and a hollow interior (not visible) is attached to the bottom 40 of the perimeter of the body. A battery 42 is releasably secured within the interior of the battery compartment by a cap 44 attached to the rear of the battery compartment. The battery is electrically connected to the circuit board and light source. The battery compartment can alternatively be attached to the body in other locations, including to the body cap as shown in FIG. 1.

The inner body 26 is a cylindrical body having a closed front 46, open rear 48, perimeter 50, and hollow interior 52. The front of the interior of the inner body receives a spider holder 54, which is a spider of elongated elements extending radially away from and supporting a focusing lens 62. The spider holder has four arms 56 that suspend a ring 58 having an aperture 60 in the center of the interior. The focusing lens 62 is received within the aperture to suspend the focusing lens in the center of the interior. The front of the inner body also includes a peripherally transmissive zone surrounding the focusing lens and having a different optical characteristic than the focusing lens. In the current embodiment, the peripherally transmissive zone is a non-corrective window 100, which makes the spider holder more rigid or unnecessary if the focusing lens is attached to, or assembled into, a cutout in the non-corrective window. A collimating lens 64 is received within the rear of the interior of the inner body at a fixed longitudinal position relative to the focusing lens. The inner body can be regarded as a lens assembly associated with the light source having a first element (the collimating lens) and a second element (the focusing lens). The vertical and horizontal position of the collimating lens within the rear of the interior of the body is controlled by a spring biasing element 66 located on the rear of the interior of the inner body, an elevation turret 68 protruding through a top aperture 70 in the perimeter of the inner body, and a windage turret 72 protruding through a right side aperture 74 in the perimeter of the inner body. The spring biasing element pushes against the perimeter 76 of the collimating lens to force contact between the perimeter of the collimating lens and the elevation and windage turrets. A gobo 78 is present on the rear surface 80 of the collimating lens as an integral feature that is etched, inscribed, molded, or applied to the rear surface, or as a second reticle component adjacent to the rear surface. The gobo can also employ Light Emitting Diode (LED) cells to enable live information and/or a dynamically-generated shape to be projected. The gobo can be considered to be an aiming figure. The gobo/aiming figure can be adjacent to, abut, or formed on the first element/collimating lens. In the current embodiment, the gobo consists of crosshairs having a center 82. The elevation and windage turrets are used to establish a zero point for the targeting device 10. The zero point is determined by adjusting the position of the collimating lens relative to the pistol's barrel 202 using the elevation and windage turrets until the impact point on a target of a bullet fired by the pistol matches the center of the gobo when projected on the target at a known distance. Alternatively, an adjustable mount used to secure the body 12 to the pistol 200 could be used to establish a zero point for the targeting device instead of including elevation and windage turrets on the targeting device.

When the targeting device 10 is assembled with the inner body 26 received within the front 20 of the body 12, the elevation turret 68 protrudes through the top longitudinal sliding cutout 14, and the windage turret 72 protrudes through the right side longitudinal sliding cutout 16. Pressure can be applied to the turrets to move the inner body forward and rearward within the body to the extent permitted by the length of the sliding cutouts. Thus, the position of the collimating lens relative to the light source 32 can be varied by the user to create the desired effect. The inner body/lens assembly is movable with respect to the light source through a range of positions between a more proximate position and a less proximate position. The elevation turret has a locking mechanism 84 that releasably secures the inner body in a fixed position within the body to prevent longitudinal movement of the inner body. In the current embodiment, the locking mechanism is a screw that can be tightened to keep the inner body in place. However, any suitable locking mechanism can be employed.

Figure 4:
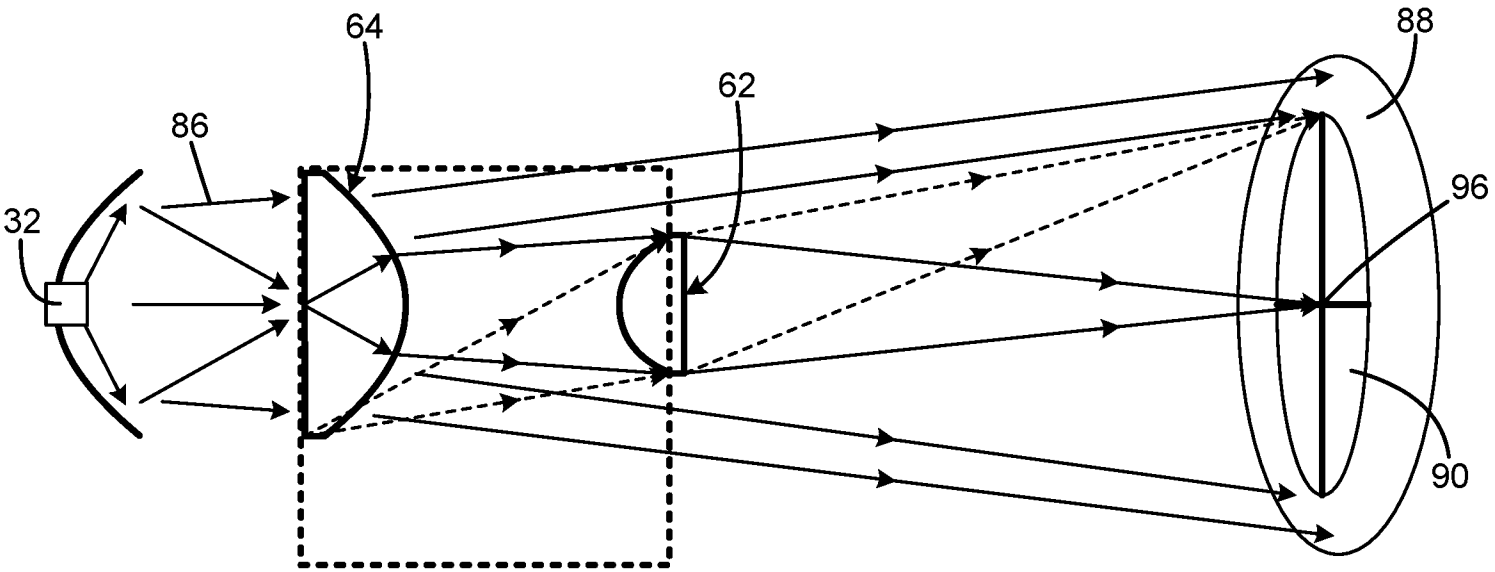
FIG. 4 is a schematic view of the gobo projection targeting device of FIG. 1 with the inner body positioned within the body to produce a narrow illuminated field.
Figure 5:
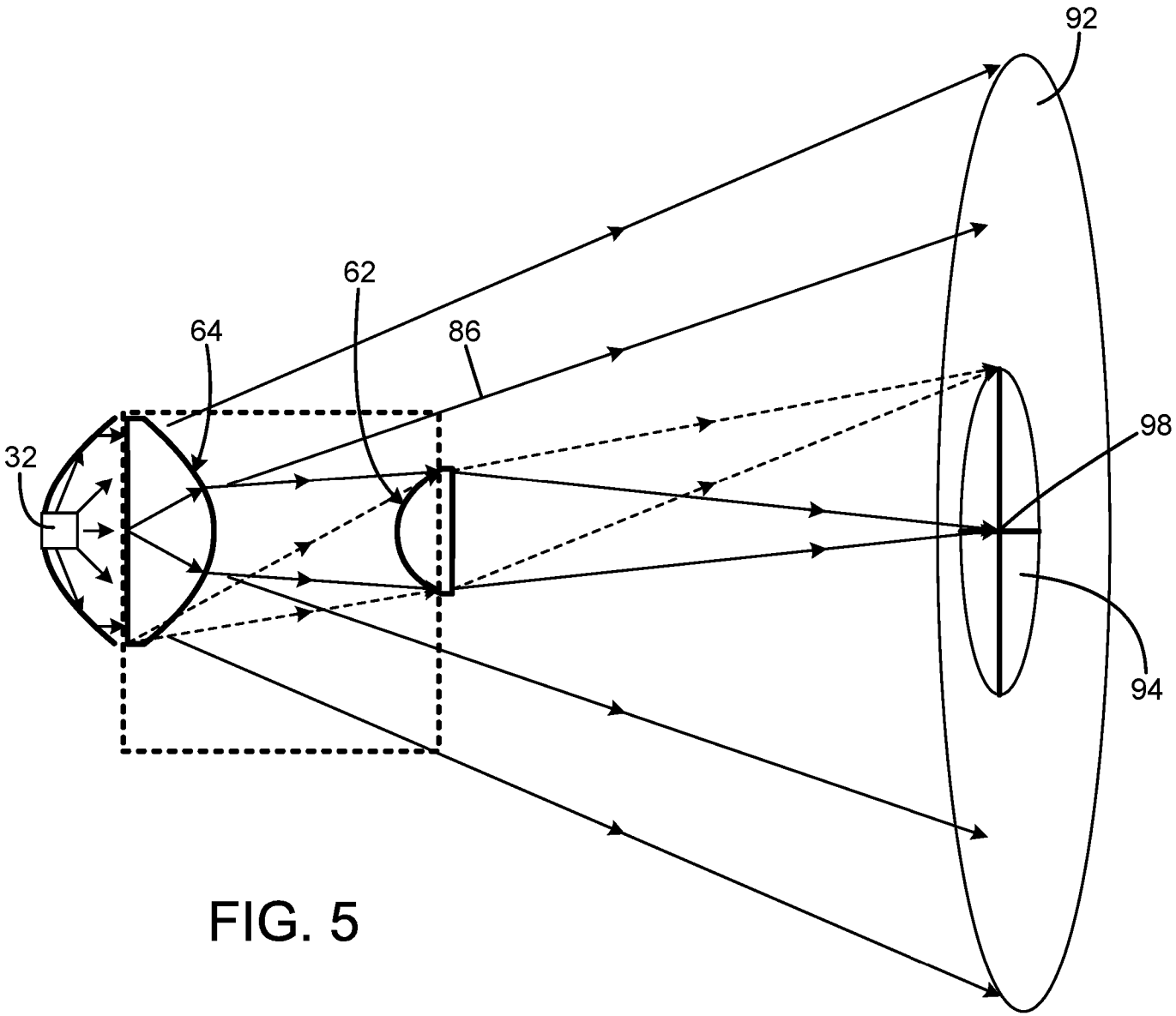
FIG. 5 is a schematic view of the gobo projection targeting device of FIG. 1 with the inner body positioned within the body to produce a broad illuminated field.

FIGS. 4 and 5 illustrate the improved gobo projection targeting device 10 of the present invention. More particularly, in FIG. 4, the targeting device is shown with the inner body 26 (not shown) positioned forward within the body 12 (not shown). As a result, the collimating lens 64 is sufficiently forward of the reflector 28 such that light rays 86 emitted by the light source 32 that only pass through the collimating lens diverge minimally and project a narrow illuminated field 88 on a target. The light rays that pass through both the collimating lens and the focusing lens 62 are partially blocked by the gobo 78, resulting in a projected image 90 of the gobo on the target. Thus, the focusing lens is adapted to generate an image of the gobo/aiming figure away from the targeting device through the range of inner body/lens assembly positions. The center 96 of the projected image is aligned with the impact point of a bullet fired by the pistol 200 if the target is at the distance used to establish the zero point for the targeting device 10. The focusing lens/second element has a smaller diameter than the collimating lens/first element, such that a first portion of light emitted by the light source and transmitted by the first element will bypass the second element and a second portion of light emitted by the light source and transmitted by the first element will not bypass the second element. However, it should be appreciated that the focusing lens/second element could be the same size as or larger than the first element if the second element is smaller than the beam angle of the first element. A bypass can also be used to provide some light passing through both the first and second elements, and some light passing through only the first element. The first portion of light is a field illumination pattern lacking a focused image. The first portion of light illuminates a field having an angular size that varies based on the position of the lens assembly (the collimating and focusing lenses). The first portion of light passes through the peripherally transmissive zone/non-corrective window 100.

In FIG. 5, the targeting device 10 is shown with the inner body 26 (not shown) positioned rearward within the body 12 (not shown). As a result, the collimating lens is sufficiently close to the reflector 28 such that light rays 86 emitted by the light source 32 that only pass through the collimating lens 64 diverge maximally and project a broad illuminated field 92 on a target. The light rays that pass through both the collimating lens and the focusing lens 62 are partially blocked by the gobo 78, resulting in a projected image 94 of the gobo on the target. The center 98 of the projected image is aligned with the impact point of a bullet fired by the pistol 200 if the target is at the distance used to establish the zero point for the targeting device 10.

Unlike a laser aiming device, the targeting device 10 produces a blinding or distracting light when viewed by the target, and the target cannot readily determine the user is viewing the projected image of the aiming point. The targeting device also enables the user's eyes to recover faster from the flash of a discharged firearm compared to when a laser is used as an aiming device.

In the current embodiment, the focusing lens 62 and the collimating lens 64 are both converging planoconvex lenses. The convex side of the focusing lens is installed in the inner body 26 facing rearward, and the convex side of the collimating lens is installed in the inner body facing forward. The breadth of the illuminated field is user-adjustable by sliding the inner body forward within the body to the extent permitted by the longitudinal sliding cutouts 14, 16 to broaden the illuminated field and increase the size of the projected image and by sliding the inner body rearward within the body to the extent permitted by the longitudinal sliding cutouts to narrow the illuminated field and decrease the size of the projected image. The locking mechanism 84 enables the user to releasably secure the inner body within the outer body to maintain a selected breadth of illuminated field. The illuminated field and projected image are orders of magnitude distant relative to the distance between the focusing lens and the collimating lens. The light source 32 is always positioned closer to the collimating lens than the focal length of the collimating lens to generate a portion of illuminated field that is larger than the projected image. The focusing lens is located at the focal point of the collimating lens and is smaller than the collimating lens. Thus, the focusing lens receives only a portion of the diverging light rays emitted by the collimating lens and converges them at a distance to produce a projected image that is smaller than the illuminated field. In the current embodiment, the focusing lens part 32848 Lens PCX 6 mm with a focal point of 36 mm manufactured by Edmund Optics of Barrington, N.J. In the current embodiment, the collimating lens has a focal point of 100 mm.

Figure 6:
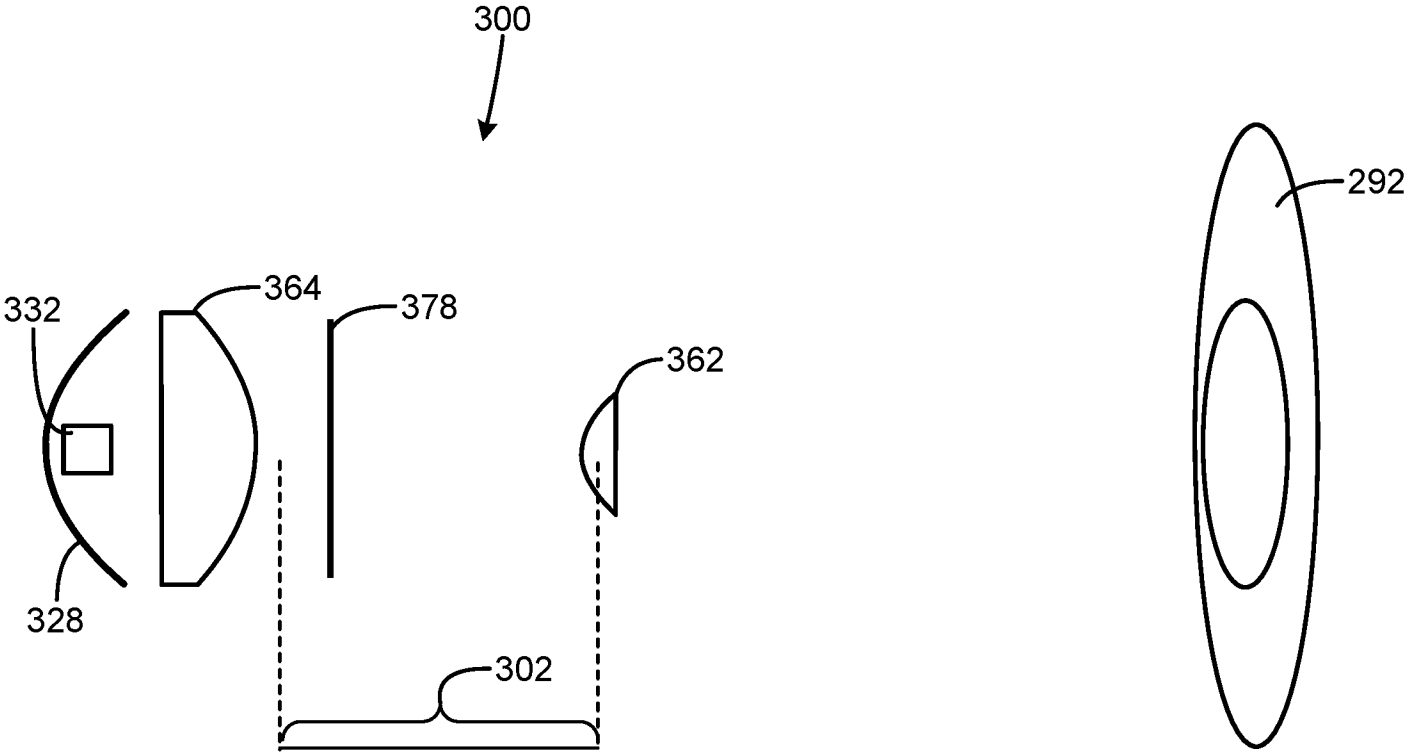
FIG. 6 is a schematic view of an alternative embodiment of the gobo projection targeting device with the focusing lens positioned to produce an illuminated field without an image of the gobo.
Figure 7:
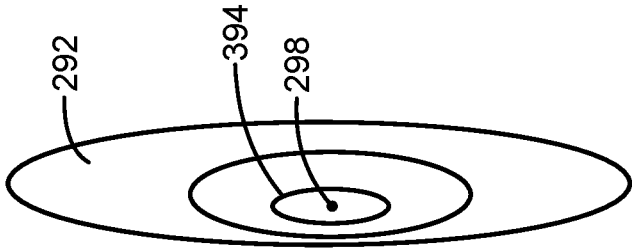
FIG. 7 is a schematic view of the alternative embodiment of the gobo projection targeting device of FIG. 6 with the focusing lens positioned to produce an illuminated field with an image of the gobo.
Figure 7:
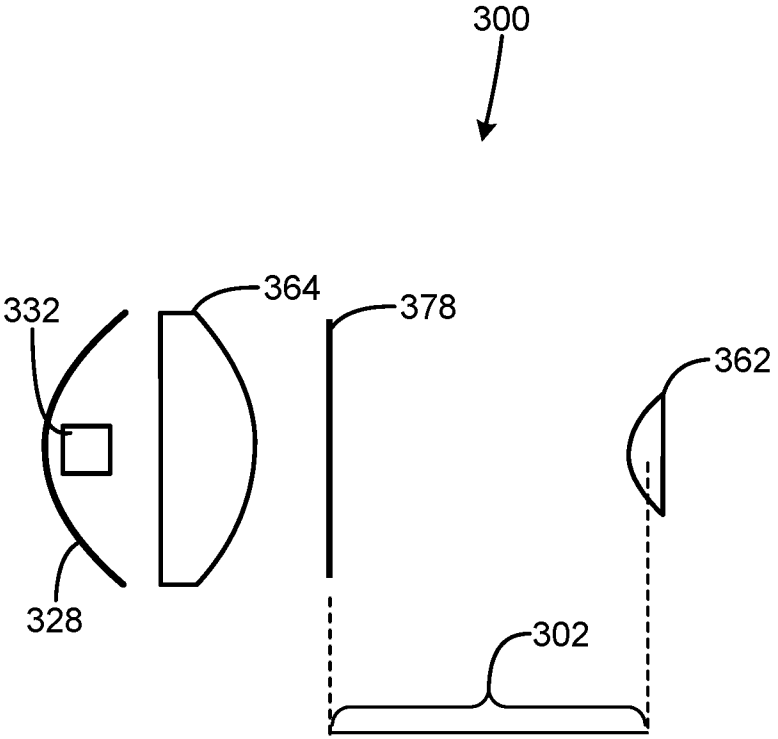

FIGS. 6 and 7 illustrate an alternative embodiment of the improved gobo projection targeting device 300 of the present invention. More particularly, the targeting device 300 has a gobo 378 positioned between the collimating lens 364 and the focusing lens 362, and a reflector 328 with light source 332 positioned rearward of the collimating lens. Unlike the targeting device 10, the targeting device 300 enables the longitudinal distance between the focusing lens and the collimating lens to be adjusted by the user. This positioning of the gobo and adjustability of the longitudinal distance enables the targeting device 300 to function as a normal flashlight in addition to providing a gobo projection capability.

In FIG. 6, the targeting device 300 is shown with the focusing lens 362 positioned closer to the gobo 378 than the focal length 302 of the focusing lens. As a result, the image of the gobo is sufficiently unfocused that the illuminated field 292 resulting from light rays transmitted by the collimating lens 364 and focusing lens projects an illuminated field 292 on a target without a visible image of the gobo. In FIG. 7, the targeting device 300 is shown with the focusing lens 362 positioned in front of the gobo at a distance corresponding to the focal lens of the focusing lens. As a result, the light rays that pass through both the collimating lens and the focusing lens are partially blocked by the gobo, resulting in a projected image 394 of the gobo on the target. The center 298 of the projected image is aligned with the impact point of a bullet fired by the pistol 200 if the target is at the distance used to establish the zero point for the targeting device 300.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While current embodiments of a gobo projection targeting device have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although pistols are described, the invention is also suitable for use with rifles, carbines, and aircraft or other vehicle-mounted firearms. In the case of an aircraft or other vehicle-mounted firearms application of the current invention, the target will only see a light, which could be interpreted as a simple search light, flashlight, or vehicle headlight. However, the user will see the target, at least a portion of the target's surroundings, and the projected image of the aiming point. Furthermore, although a light source emitting visible light and a gobo blocking visible light is disclosed, any desired wavelength of light could be emitted, including those not visible to humans without a secondary device to view that wavelength of light, and a gobo blocking any desired wavelength of light could be used. In addition to the crosshairs described, the gobo could have any desired shape or pattern, including circles and dots. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm aiming illuminator comprising:

a light source;

a lens assembly associated with the light source;

the lens assembly having a first element, a second element, and an extended multi-point reticle aiming figure;

the first element being closer to the light source;

the second element having a smaller diameter than the first element, such that a first portion of light emitted by the light source and transmitted by the first element will bypass the second element and a second portion of light emitted by the light source and transmitted by the first element will pass through the second element; and wherein the second element is adapted to generate an image of the extended multi-point reticle aiming figure away from the illuminator.

2. The firearm aiming illuminator of claim 1 wherein the first and second elements are each converging lenses.

3. The firearm aiming illuminator of claim 1 wherein the first portion of light is a field illumination pattern lacking a focused image.

4. The firearm aiming illuminator of claim 1 wherein the lens assembly is movable with respect to the light source through a range of positions between a more proximate position and a less proximate position.

5. The firearm aiming illuminator of claim 4 wherein the second element is adapted to generate an image of the extended multi-point reticle aiming figure away from the illuminator thorough the range of lens assembly positions.

6. The firearm aiming illuminator of claim 5 wherein the first portion of light illuminates a field having an angular size that varies based on the position of the lens assembly.

7. The firearm aiming illuminator of claim 1 including a peripherally transmissive zone surrounding the second lens element and having a different optical characteristic than the second lens element, the first portion of light passing through the peripherally transmissive zone.

8. The firearm aiming illuminator of claim 7 wherein the peripherally transmissive zone is a non-corrective window.

9. The firearm aiming illuminator of claim 7 wherein the second element is supported by a spider of elongated elements extending radially away from the second lens element.

10. The firearm aiming illuminator of claim 1 wherein the extended multi-point reticle aiming figure is adjacent to the first element.

11. The firearm aiming illuminator of claim 1 wherein the extended multi-point reticle aiming figure abuts the first element.

12. The firearm aiming illuminator of claim 1 wherein the extended multi-point reticle aiming figure is formed on the first element.

* * * * *